United States Patent [19]

Land

[11] 4,070,736

[45] Jan. 31, 1978

[54] FASTENING DEVICE

[76] Inventor: Walter Henry Land, 656 Nepean Highway, Frankston, Victoria, Australia, 3I99

[21] Appl. No.: 725,413

[22] Filed: Sept. 21, 1976

[30] Foreign Application Priority Data

Sept. 25, 1975 Australia ..... 3324/75

[51] Int. Cl.[2] ..... A44B 9/00

[52] U.S. Cl. ..... 24/153; 402/15; 24/153.1

[58] Field of Search ..... 24/153 FB, 153 BP, 153 R, 24/153.1; 402/15

[56] References Cited

U.S. PATENT DOCUMENTS

| | | | |
|---|---|---|---|
| 1,927,623 | 9/1933 | Anderson | 24/153.1 |
| 2,160,564 | 5/1939 | Roscoe | 402/15 |
| 2,192,701 | 3/1940 | Vogel | 24/153 R |
| 2,328,268 | 8/1943 | Gelfand | 24/153.1 |
| 2,328,416 | 8/1943 | Blizard | 24/153.1 |
| 2,386,723 | 10/1945 | Sparks | 24/153 R |
| 2,498,901 | 2/1950 | Segal | 402/17 |
| 2,888,055 | 5/1959 | Dingman | 24/153.1 |
| 3,362,411 | 1/1968 | Moller | 402/15 |

FOREIGN PATENT DOCUMENTS

| | | | |
|---|---|---|---|
| 713,853 | 7/1965 | Canada | 402/15 |
| 258,793 | 12/1960 | Netherlands | 402/15 |
| 862,775 | 3/1961 | United Kingdom | 402/17 |

*Primary Examiner*—Bernard A. Gelak
*Attorney, Agent, or Firm*—Depaoli & O'Brien

[57] ABSTRACT

A quick-release paper fastener of polypropylene-ethylene copolymer for stacks of two holed sheets and comprising a tongued base member and a compressor which has resilient hooks provided with transverse V-shaped ribs on the undersurface which co-operates with a central V-shaped groove on the outer surface of the tongue to provide a snap-fit locking and quick release arrangement and the compressor has a transverse bar near each slot which engages with transverse grooves and ribs or notches on the inner surface of the tongue to prevent longitudinal slipping of the tongue when folded over in the fastened position.

10 Claims, 7 Drawing Figures

FASTENING DEVICE

BACKGROUND OF THE INVENTION

Metal paper fasteners for holding stacks of perforated paper have been devised which are constructed in two basic parts, namely a rectangular base member terminating in a narrow tongue portion at each end and a rectangular compressor which is provided with a transverse tongue-receiving slot adjacent each end thereof. One such fastener has a compressor in which each tongue of the base member is passed through the respective slot in the compressor and then a sharp edge of the tongue has to be pushed into a slit provided in a longitudinal ridge which is provided and extends along the top ede of the compressor. Such a ridge may also have opposed hooks. However, in order close or open the fastener it is usually necessary for the user to apply finger force to the sharp and mostly buried locked under edge of the tongue which can result in cut fingers. Other similar fasteners have locking lugs in the tongues and even ramped members in the compressor and a common feature to all is that when the tongue is pushed flat against the compressor it is usually necessary to bend or twist the tongue off-centre to the longitudinal axis of the compressor. Considerable force is then required to release the locked tongue and cut fingers can result because of the sharp edges and is frequently also necessary to use a tool or instrument to prise out the locked tongue. In another design the edges of the transverse slots of the compressor are turned out to form lips which grip the tongue when the tongue is passed down through the slots and under the compressor for locking purposes. However such locking edges would make the tongue difficult to disengage from the compressor. In yet another design a binder has back and front covers used in conjunction with a cord which can be secured in channel slots in the compressor and separate nylon locking elements are then mounted on the compressor but labor production costs would make the production of the separate components of different materials a costly and uneconomical proposition and clamping and releasing actions would not be satisfactory. Such metal component paper fasteners are prone to rust and the tongues will break off because of metal fatigue.

It is an object of this invention to provide a paper fastener which has quicker and easier locking and release actions.

Another object is to provide a paper fastener which is of economical construction, light in weight and which is rustproof and durable.

Another object is to provide a paper fastener all the components of which have smooth non-cutting edges and which is therefore safer to use.

Another object is to provide an improved two-piece paper fastener in which resilient hooks on the compressor enable a snap-fit locking action with the tongues and in which co-operating complementary members on the compressor and tongues prevent accidental transverse and longitudinal slipping of the tongues from the compressor but enable quick and easy release during unfastening.

SUMMARY

This invention provides a two-piece paper fastener made entirely of plastics material such as polypropylene-ethylene copolymer in which opposed resilient hooks on the compressor have snap-fit locking and release means on the undersurface co-operating with complementary means on the outer surface of the tongue to releasably retain the tongues against accidental lateral displacement from the hooks.

In a further aspect the compressor has releasable locking means adjacent each transverse slot thereof co-operating with means on the inner or lower surface of the tongues to prevent accidental longitudinal slipping of the tongues from the compressor.

Other features, uses and advantages of the invention will become apparent from a reading of the following description of the embodiment thereof presented in the accompanying drawings.

BRIEF DESCRIPTION OF THE DRAWINGS

The accompanying drawings illustrate present exemplary embodiments of this invention, in which.

DESCRIPTION OF ILLUSTRATED EMBODIMENTS

Figures 1, 2, 3, 4, 5, 6, 7:
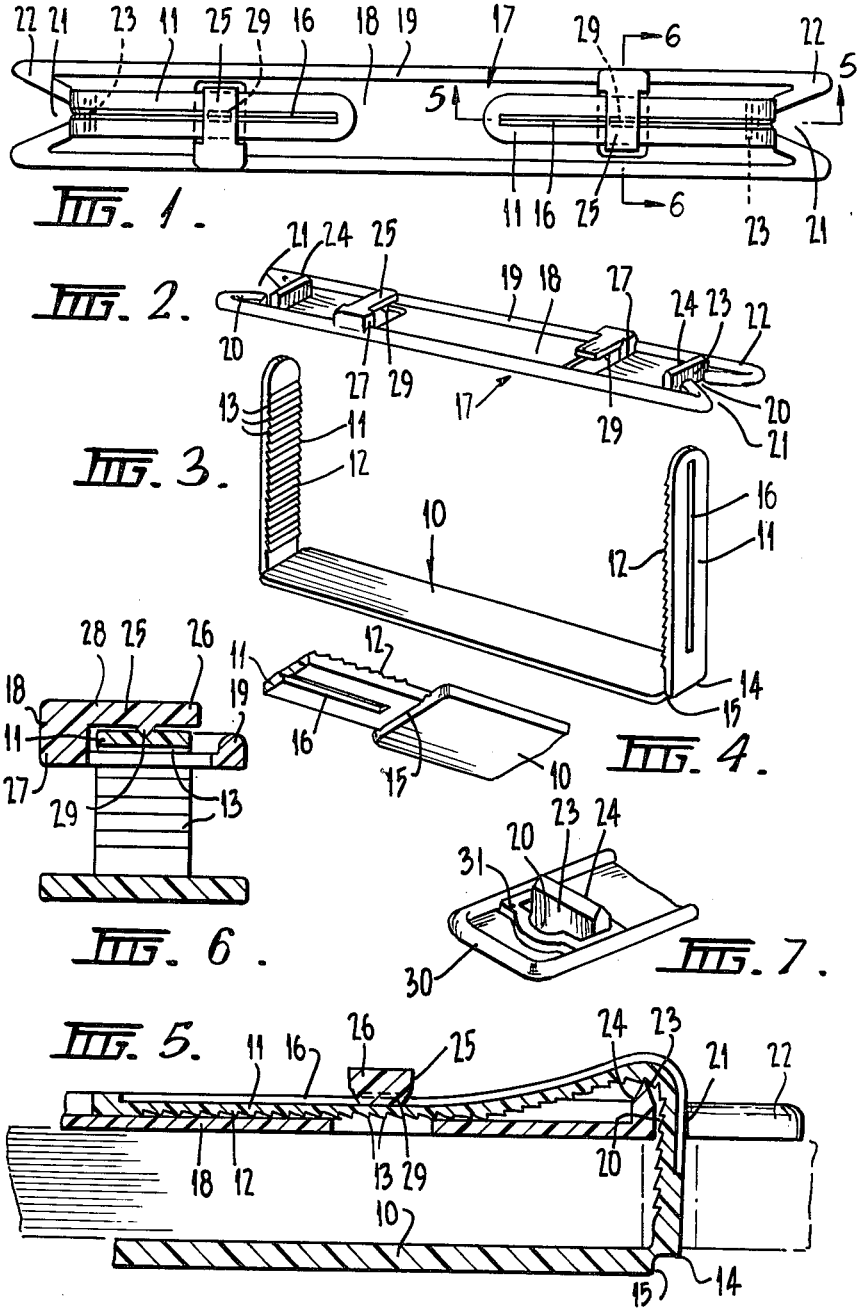
FIG. 1 is a plan view illustrating one exemplary embodiment of the assembled paper fastener of this invention shown with tongues locked along the compressor.
FIG. 2 is a perspective view particularly illustrating the upper surface of the compressor omitting base member tongues.
FIG. 3 is a perspective view of the inner upper surface of the tongues showing gripping saw-tooth type notches.
FIG. 4 is a partial underneath perspective view of the base member showing a hinge groove formed at the junction of the rectangular base and the tongue.
FIG. 5 is a sectional view taken on line 5—5 of FIG. 1.
FIG. 6 is a sectional view taken on line 6—6 of FIG. 1.
FIG. 7 is a perspective view of a modification of the compressor with closed ends around the transverse slot.

Reference is now made to FIGS. 1 and 2 of the drawings wherein an exemplary paper fastener of this invention is shown in use as a two hole paper stack binder and is constructed of polypropylene-polyethylene copolymer and formed by injection moulding in a conventional injection moulding machine. The base member is designated 10 and the tongues 11 are of conventional configuration except that the inner fold over surface 12 or that surface which is bent over and lies against the compressor has a roughened texture preferably in the form of transverse saw-tooth type ridges and grooves 13. There is also provided at the junction between each tongue and the base member 10 a plastic hinge 14 formed as a groove or cut-away portion 15 on the underside of each tongue. The plastic hinge enables the tongue to be folded or stood upright at right angles to the base member and because of the plastic memory of the material it would not be possible for the tongue to remain in this upwardly bent position without the plastic hinge. A V-shaped groove 16 is provided on the outer surface of tongue. The compressor component of the fastener is designated 17 and has a central flat plate portion 18 surrounded by a peripheral strengthening wall 19 and two transversely disposed tongue receiving slots 20 adjacent each thereof which are of sufficient width to receive the tongues and, in this embodiment, the slots open out into an open tongue entry slot 21 which taper from the outer edge of the compressor ends in towards the slots 20. The slots are preferably surrounded by a peripheral strengthening wall 22. The innermost portion of the wall of each aperture [that is to say that portion remote from and facing the ends of the base plate] is interrupted by a transverse rib member 23 which is moulded integrally with the base plate and which projects upwardly above the plane of the upper surface of the compressor and terminates at its end in a tongue-engaging knife edge 24.

At a distance about half-way between the centre and each end of the compressor, there is provided upstanding tongue-engaging and release means 25 in the form of a resilient hook member 26 having a rigid post section 27 supporting a resilient arm portion 28 set at right angles to the post. Each hook member is moulded in stamped out relationship from the central plate portion 18 of the compressor and is provided with a preferably V-shaped transverse rib 29 projecting from the underside of the arm portion 28. As previously described the outer surface of each tongue is provided with a central longitudinal groove 16 which is of complementary shape to the rib 29 and the rib, groove and resilient hook arm co-operate to form a snap-fit locking arrangement when the tongue is passed sideways under the hook and accidental lateral displacement of the tongue from the compressor when the fastener is closed is prevented.

In the modified compressor illustrated in FIG. 7 of the drawings, the compressor has closed ends and the tongue-receiving slot is of slightly key-holed configuration and opens up slightly at its mid-portion as shown at 30. A strengthening wall 31 surrounds the closed off slot.

Whilst specific embodiments of this invention have been illustrated and described, it will be understood that this is by way of illustration only, and that certain changes may be made within the concept of this invention and within the scope of the following claims.

What is claimed is:

1. A flexible, two-piece paper fastener constructed of plastics material and comprising a compressor with an aperture adjacent each end thereof, a base with an integral tongue extending from each end thereof, the junction of said base and each said tongue having a design radius forming a plastic hinge, one surface of each said tongue being roughened to engage a transverse knife edge on said compressor for engaging each said tongue when inwardly folded toward one side of said compressor as a means to prevent accidental longitudinal slipping of said tongue from said compressor, integral hook members, each having a post portion which is rigidly attached to said one side of the compressor and a transversely extending arm portion having catch means on its underside for engaging complementary catch means on the other surface of one said tongue to releasably retain said tongue in a snap-locking and quick-release arrangement under said arm portion to lock said tongues against accidental lateral displacement from said compressor.

2. A fastener as described in claim 1 wherein each said end of the compressor tapers inwardly to form an entry slot for one said tongue and then opens out to form a transverse tongue-receiving slot.

3. A fastener as described in claim 1 wherein each said tongue is integrally joined to said base by a flexible web to form said plastic hinge to enable the tongue to be bent up and remain in a position at right angles to the base to counteract the plastic memory of the material of the base.

4. A fastener as described in claim 1 wherein said catch means is in the form of a V-shaped rib extending transversely across the undersurface of said arm portion of each said hook and complementary catch means on each said tongue is in the form of a V-shaped groove extending centrally and longitudinally along the outer folded-over surface of the tongue.

5. A two-piece paper fastener, comprising:

A. an elongated base member, comprising a pair of longitudinally extending tongues at the opposite ends thereof, each tongue of said pair of tongues having a roughened surface on one side thereof and a longitudinally disposed groove on the other side thereof; and B. an elongated compressor, comprising:

1. a central plate portion having a tongue-contacting surface, a paper-contacting surface, and a pair of slots at opposite ends thereof, the distance between said slots being equal to the distance between said opposite ends of said base member,
2. a pair of transverse rib members, rigidly attached to said central plate portion, which are closely adjacent to said pair of slots and disposed therebetween, said rib members projecting beyond the plane of said tongue-contacting surface and terminating in a means for frictionally engaging said roughened surfaces of said pair of tongues, and
3. a pair of resilient hook members, which are disposed between said pair of slots as an upstanding tongue-engaging and release means for said pair of tongues, each said hook member comprising:
   a. a rigid post section which is rigidly attached to said tongue-contacting surface,
   b. a resilient arm portion which is rigidly attached to said post section and disposed at about 90° thereto and transversely to said elongated compressor so that said arm portion is spaced from said tongue-contacting surface, and
   c. a projection extending toward said tongue-contacting surface from the inner surface of said arm portion, whereby said projection engages said longitudinally disposed groove in one said tongue of said pair of tongues as a means to prevent accidental lateral displacement of said pair of tongues from said pair of resilient hook members.

6. The two-piece paper fastener of claim 5, wherein said means for frictionally engaging said roughened surfaces is a knife edge which is disposed transversely to said elongated compressor.

7. The two-piece paper fastener of claim 6, wherein said roughened surfaces are saw-tooth ridges and grooves, whereby said knife edges and said saw-tooth ridges and grooves cooperate to form a means to prevent accidental longitudinal slipping of said each tongue from said compressor.

8. A paper fastener constructed of resilient plastics material selected from the class consisting of polypropylene and polypropylene/polyethylene copolymer and comprising a base member with a pair of foldable tongues, each tongue having a centrally disposed longitudinal groove in its outer surface when said tongue is folded inwardly, and an apertured compressor for receiving and releasably fastening said tongues after the tongues have been passed through the apertures in the compressor and inwardly folded upon the compressor, said compressor comprising a pair of resilient hook members which are rigidly attached to the compressor and disposed in mutually opposed relationship, each said hook having a transverse rib on the underside thereof engaging one said centrally disposed longitudinal groove.

9. The paper fastener of claim 8 wherein the ends of the compressor are of closed form with transverse tongue receiving slots with the wall of the slot adjacent the end of the compressor being of arcuate configuration.

10. The paper fastener as described in claim 8 wherein the compressor is provided with a peripheral strengthening wall upstanding from the tongue-contacting upper surface of the compressor.

* * * * *